United States Patent [19]

Burnham

[11] 4,324,490

[45] Apr. 13, 1982

[54] DEVELOPMENT SYSTEM

[75] Inventor: Paul W. Burnham, Webster, N.Y.

[73] Assignee: Xerox Corporation, Stamford, Conn.

[21] Appl. No.: 144,510

[22] Filed: Apr. 28, 1980

[51] Int. Cl.[3] ..... G03G 15/00; G03G 15/09

[52] U.S. Cl. ..... 355/3 DD; 118/657; 118/661

[58] Field of Search ..... 355/3 R, 3 DD, 4; 118/653, 655, 656, 657, 658, 661

[56] References Cited

U.S. PATENT DOCUMENTS

| | | | |
|---|---|---|---|
| 3,614,221 | 10/1971 | Solarek | 355/3 DD |
| 3,636,924 | 1/1972 | Weiler | 118/656 X |
| 3,664,857 | 5/1972 | Miller | 118/637 X |
| 3,884,185 | 5/1975 | Liebman | 118/656 |
| 4,239,017 | 12/1980 | Schwarz | 118/656 |
| 4,240,740 | 12/1980 | Young | 355/3 DD |

FOREIGN PATENT DOCUMENTS 53-67438 6/1978 Japan .

*Primary Examiner*—Fred L. Braun

*Attorney, Agent, or Firm*—H. Fleischer; H. M. Brownrout

[57] ABSTRACT

An apparatus in which developer material is guided to the free end regions of fibers to develop a latent image. The apparatus includes a tubular member having a ramp shaped member secured thereto for guiding the developer material to the fibers extending outwardly from the tubular member in the region of the latent image. An elongated magnetic member, disposed interiorly of the tubular member, rotates so as to transport developer material about the tubular member.

30 Claims, 5 Drawing Figures

DEVELOPMENT SYSTEM

This invention relates generally to an apparatus for developing a latent image with a developer material. An apparatus of this type is frequently employed in an electrophotographic printing machine.

Generally, in the process of electrophotographic printing a photoconductive member is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After recording the electrostatic latent image on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material comprises toner particles adhering triboelectrically to carrier granules. This two component mixture is brought into contact with the latent image. The toner particles are attracted from the carrier granules to the latent image forming a powder image thereof.

With the advent of single component developer materials, carrier granules are no longer required. Though development is optimized by employing particles having low resistivity or good conductivity, transfer is optimized by employing particles having high resistivity. Thus, the printing machine is faced with two contradictory requirements, i.e. the utilization of particles having low resistivity for optimum development and the requirement of high resistivity to optimize transfer. It has been found that when more resistive particles are employed, they frequently produce images having portions of the solid areas deleted. Various approaches have been devised to improve development.

The following disclosures appear to be relevant:

U.S. Pat. No. 3,614,221
Patentee: Solarck
Issued: Oct. 19, 1971

U.S. Pat. No. 3,664,857
Patentee: Miller
Issued: May 23, 1972

Japanese Patent Laid Open No.: 53-67438
Laid Open Date: June 15, 1978
Japanese patent application No.: 51-142260
Application Date: Nov. 29, 1976

Co-pending U.S. patent application Ser. No.: 023,935
Applicant: Burnham
Filed: Mar. 26, 1979

Copending U.S. patent application
Ser. No.: 047,615
Applicant: Young
Filed: June 11, 1979

The pertinent portions of the foregoing disclosures may be briefly summarized as follows.

In accordance with the features of the present invention, there is provided an apparatus for developing a latent image with a developer material. The apparatus includes means for transporting the developer material. A plurality of fibers extend outwardly from the transporting means. The free end regions of at least a portion of the fibers are closely adjacent the latent image. Means are provided for guiding the developer material to the free end regions of the fibers to develop the latent image therewith.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
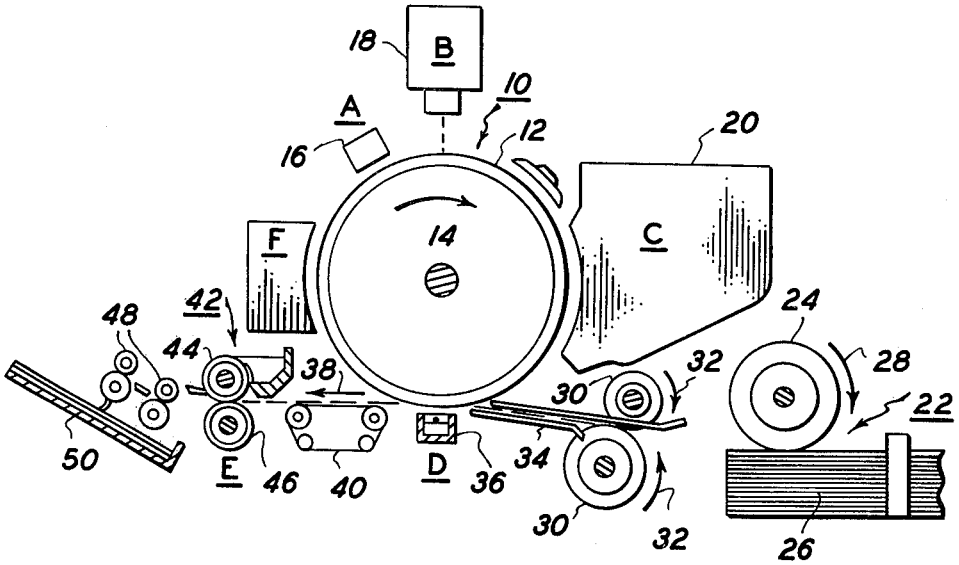
FIG. 1 is a schematic elevational view depicting an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the development apparatus of the present invention therein. It will become evident from the following discussion that this development apparatus is equally well suited for use in a wide variety of electrostatographic printing machines, and is not necessarily limited in its application to the particular embodiment depicted herein.

Inasmuch as the art of electrophographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12. Preferably, photoconductive surface 12 comprises a transport layer containing a small molecule dispersed in an organic resinous material and a generation layer of trigonal selenium. Drum 10 moves in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high substantially uniform potential.

Next, the charged portion of photoconductive surface 12 is advanced through exposure station B. Exposure station B includes an exposure system, indicated generally by the reference numeral 18. In exposure system 18, an original document is positioned face-down upon a transparent platen. Light rays reflected from the original document are transmitted through a lens to form a light image thereof. The light image is projected onto the charged portion of photoconductive surface 12 to selectively dissipate the charge thereon. This records an electrostatic latent image on photoconductive surface 12 which corresponds to the informational areas contained within the original document. Thereafter, drum 10 advances the electrostatic latent image recorded on photoconductive surface 12 to development station C. At development station C, a magnetic brush development system, indicated generally by the reference numeral 20, advances magnetic particles into contact with the electrostatic latent image. The latent image attracts the particles forming a particle image on photoconductive surface 12 of drum 10. The detailed structure of the development system will be described hereinafter with reference to FIGS. 2 through 5, inclusive.

Drum 10 then advances the particle image to transfer station D. At transfer station D, a sheet of support material is moved into contact with the particle image. A sheet of support material is advanced to transfer station D by a sheet feeding apparatus, indicated generally by the reference numeral 22. Preferably, sheet feeding apparatus 22 includes a feed roll 24 contacting the uppermost sheet of the stack of sheets 26. Feed roll 24 rotates in the direction of arrow 28 so as to advance the uppermost sheet into the nip defined by forwarding rollers 30. Forwarding rollers 30 rotate in the direction of arrow 32 to advance the sheet into chute 34. Chute 34 directs the advancing sheet of support material into contact with the photoconductive surface of drum 10 so that the particle image developed thereon contacts the advancing sheet at transfer station D.

Preferably, transfer station D includes a corona generating device 36 which sprays ions onto the backside of the sheet. This attracts the particle image from photoconductive surface 12 to the sheet. After transfer, the sheet continues to move in the direction of arrow 38 onto a conveyor 40 which advances the sheet to fusing station E.

Fusing station E includes a fuser assembly, indicated generally by the reference numeral 42, which permanently affixes the transferred particle image to the sheet. Preferably, fuser assembly 42 includes a heated fuser roller 44 and a back-up roller 46. The sheet passes between fuser roller 44 and back-up roller 46 with the particle image contacting fuser roller 44. In this manner, the particle image is permanently affixed to the sheet. After fusing, forwarding rollers 48 advance the sheet to catch tray 50 for subsequent removal from the printing machine by the operator.

It is believed that the foregoing description is sufficient for purposes of the present application to illustrate the general operation of an electrophotographic printing machine incorporating the features of the present invention therein.

Figure 2:
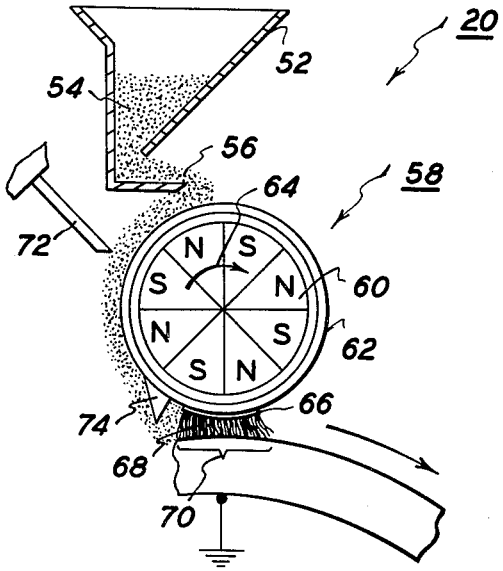
FIG. 2 is a sectional elevational view of a development system employed in the FIG. 1 printing machine.

Referring now to the specific subject matter of the present invention, as shown in FIG. 2, development system 20 includes a hopper 52 storing a supply of magnetic particles 54 therein. Particles 54 descend through aperture 56 in hopper 52 onto the surface of a developer roller, indicated generally by the reference numeral 58. Developer roller 58 includes an elongated cylindrical magnet 60 mounted interiorly of tubular member 62. Tubular member 62 remains substantially stationary with magnetic member 60 rotating in the direction of arrow 64. An electrically conductive fabric member 66 is secured to tubular member 62. Preferably, fabric member 66 is cemented to tubular member 62 in the region of development zone 68. A multiplicity of tufts 70 extend in an outwardly direction from fabric 66. Each tuft 70 is woven through fabric 66 and comprises a multiplicity of fibers. Tufts 70 are closely adjacent to photoconductive surface 12 of drum 10 in development zone 68. Particles 56, which are insulative, adhere to the tips of the tufts to prevent discharge. A voltage source (not shown) electrically biases fabric 66 to a suitable magnitude and polarity to suppress background development. Preferably, each fiber of tuft 70 is made from an electrically conductive magnetic stainless steel. Tubular member 62 is made from a non-magnetic material, such as aluminum. Magnet 60 is, preferably, made from barium ferrite having a magnetic field impressed thereon. Metering blade 72 defines a gap between tubular member 62 and the free end region thereof. This gap regulates the quantity of particles being transported into contact with the electrostatic latent image recorded on photoconductive surface 12. Preferably, metering blade 72 is made from a thin stainless steel blade. A ramp-shaped member 74 is secured to tubular member 62 extending along the exterior surface thereof substantially parallel to the longitudinal axis just prior to the entrance to development zone 68. In this way, the particles being advanced on tubular member 62 move over ramp 74 so as to be transported to the tips of tufts 70. Preferably, ramp 74 is made from a non-magnetic material secured to stationary tubular member 62 by any suitable means such as cement or fastners.

Figure 3:
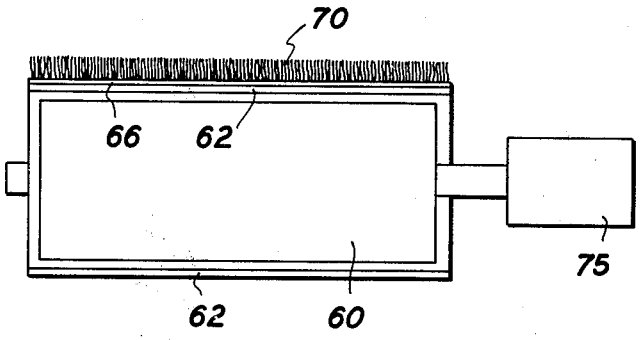
FIG. 3 is a schematic elevational view of a developer roller used in the FIG. 2 development system.

Turning now to FIG. 3, developer roller 58 is shown thereat in greater detail. As depicted in FIG. 3, non-magnetic tubular member 62 has fabric 66 secured thereto. Fabric 66 includes a multiplicity of tufts 70 extending outwardly therefrom. Each tuft 70 includes a multiplicity of stainless steel fibers. Tubular member 62 has cylindrical magnets 60 disposed interiorly thereof. Magnet 60 is mounted rotatably within tubular member 62. Magnet 60 is rotated by a constant speed motor 75. In this way, the magnetic particles move in the opposite direction to the direction of angular rotation of magnet 60, as shown in FIG. 2. Tufts 70 are of sufficient length to have the free end portions thereof closely adjacent to photoconductive surface 12. As drive motor 75 rotates magnet 60, particles 54 move around tubular member 62 and over ramp 74 onto the tips of tufts 70 in development zone 68. In development zone 68, particles 54 contact the electrostatic latent image. This insures that the particle image deposited on photoconductive surface 12 of drum 10 is substantially uniform having no deletions therein.

Figure 4:
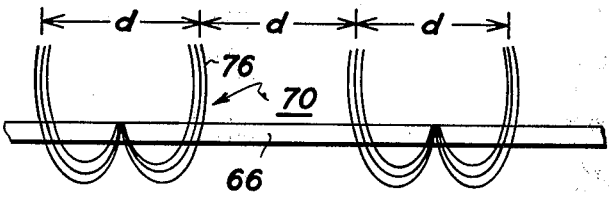
FIG. 4 is a fragmentary, exploded view depicting one embodiment of the fiber weave of the FIG. 3 developer roller.

Referring now to FIG. 4, there is shown one manner in which tufts 70 may be secured to fabric 66. Each tuft 70 includes a multiplicity of stainless steel fibers 76. Each fiber 76 in tuft 70 passes through fabric 66 in a W-shaped configuration. The distance "d" between each adjacent tuft 70 is substantially equal.

Figure 5:
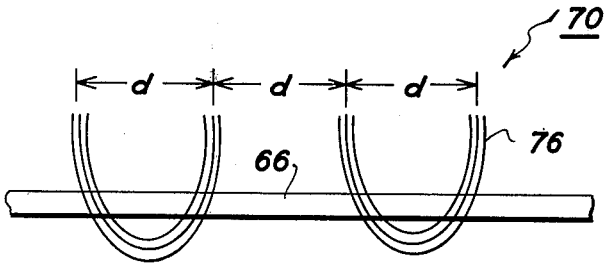
FIG. 5 is a fragmentary, exploded view depicting another embodiment of the fiber weave of the FIG. 3 developer roller.

An alternate method of weaving tufts 70 in fabrics 66 is shown in FIG. 5. As depicted thereat, each fiber 76 of each tuft 70 passes through fabric 66 in a U-shaped configuration. Once again, the distance "d" between each adjacent tuft 70 is substantially equal.

By way of example, the fabric is preferably made from cotton having a conductive coating of black latex heavily loaded with carbon thereon. Preferably, each tuft has from about 500 to about 1500 fibers therein. Each fiber ranges from about 0.005 to about 0.015 millimeters in thickness. It has been found that the density of the tufts is important and that too great a density prevents independent movement of each fiber and results in particle blockages causing image streaking. Hence, it is preferred that there be from about 8 to about 16 tufts per square centimeter of fabric. The distance, "d," between each adjacent tuft is preferably equal and ranges from about 0.20 centimeters to about 0.25 centimeters. It is desirable that the tufts be of sufficient length to form a fairly soft brush. The length of the tufts is but one parameter in defining the softness of the brush, another parameter being the manner of the weave. It has been found that a W-shaped weave, as shown in FIG. 4, is stiffer than a U-shaped weave. as illustrated in FIG. 5.

In recapitulation, it is evident that the improved development system of the present invention utilizes a ramp to guide developer particles onto the tips of fibers closely adjacent the photoconductive surface. Particle advancement is achieved by rotating a magnet relative to a tubular member having the particles adhering thereto. A ramp, closely adjacent to the development zone, guides the moving particles to the tips of fibers so as to contact the electrostatic latent image recorded on the photoconductive surface. This insures that sufficient particles are advanced to the development zone to form a substantially uniform particle image.

It is, therefore, evident that there has been provided in accordance with the present invention an apparatus for developing an electrostatic latent image recorded on a photoconductive surface. This apparatus fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. An apparatus for developing a latent image with developer material, including:

means for transporting the developer material;

a plurality of fibers extending outwardly from said transporting means with the free end regions of at least a portion of said fibers being closely adjacent to the latent image; and means, secured to said transporting means, for guiding the developer material being transported to the free end regions of said fibers to develop the latent image therewith.

2. An apparatus according to claim 1, wherein the developer material includes magnetic particles.

3. An apparatus according to claim 2, wherein said transporting means includes:

an elongated tubular member having said guiding means secured thereto; and means for generating a magnetic field to attract said magnetic particles to said tubular member.

4. An apparatus according to claim 3, wherein said plurality of fibers are preferably electrically conductive and magnetic.

5. An apparatus according to claim 4, wherein said generating means includes an elongated magnetic member disposed interiorly of said tubular member.

6. An apparatus for developing a latent image with developer material comprising at least magnetic particles, including:

an elongated tubular member;

an elongated magnetic member disposed interiorly of said tubular member for attracting the developer material;

a plurality of electrically conductive and magnetic fibers extending outwardly from said tubular member with the free end regions of at least a portion of said fibers being closely adjacent to the latent image; and a ramp-shaped member secured to said tubular member in the region of said plurality of fibers to guide the developer material to the free end regions of said fibers.

7. An apparatus according to claim 6, wherein said tubular member is stationary.

8. An apparatus according to claim 7, including means for rotating said magnetic member.

9. An apparatus according to claim 8, wherein said plurality of fibers are grouped together to form a multiplicity of spaced tufts with each of said tufts having a multiplicity of said fibers.

10. An apparatus according to claim 9, wherein the spacing between adjacent tufts is substantially equal.

11. An apparatus according to claim 10, further including a fabric secured to said tubular member and having said tufts woven therethrough.

12. An apparatus according to claim 11, wherein said fabric includes a conductive coating.

13. An apparatus according to claim 12, wherein said tufts are woven through said fabric in a W-shaped configuration.

14. An apparatus according to claim 12, wherein said tufts are woven through said fabric in a U-shaped configuration.

15. An apparatus according to claim 13 or 14, wherein said fibers are made preferably from stainless steel.

16. An electrophotographic printing machine of the type in which an electrostatic latent image recorded on a photoconductive member is developed with a developer material, wherein the improvement includes:

means for transporting the developer material;

a plurality of fibers extending outwardly from said transporting means with the end regions of at least a portion of said fibers being closely adjacent to the photoconductive member; and means, secured to said transporting means, for guiding the developer material being transported to the free end regions of said fibers to develop the latent image recorded on the photoconductive member.

17. A printing machine according to claim 16, wherein the developer material includes magnetic particles.

18. A printing machine according to claim 17, wherein said transporting means includes:

an elongated tubular member having said guiding means secured thereto; and means for generating a magnetic field to attract said magnetic particles to said tubular member.

19. A printing machine according to claim 18, wherein said plurality of fibers are preferably electrically conductive and magnetic.

20. A printing machine according to claim 19, wherein said generating means includes an elongated magnetic member disposed interiorly of said tubular member.

21. An electrophotographic printing machine of the type in which an electrostatic latent image recorded on a photoconductive member is developed with a developer material comprising at least magnetic particles, wherein the improvement includes:

an elongated tubular member;

an elongated magnetic member disposed interiorly of said tubular member for attracting developer material;

a plurality of electrically conductive and magnetic fibers extending outwardly from said tubular member with the end regions of at least a portion of said fibers being closely adjacent to the photoconductive member; and a ramp-shaped member secured to said tubular member in the region of said plurality of fibers to guide the developer material to the free end regions of said fibers.

22. A printing machine according to claim 21, wherein said tubular member is stationary.

23. A printing machine according to claim 22, including means for rotating said magnetic member.

24. A printing machine according to claim 23, wherein said plurality of fibers are grouped together to form a multiplicity of spaced tufts with each of said tufts having a multiplicity of said fibers.

25. A printing machine according to claim 24, wherein the spacing between adjacent tufts is substantially equal.

26. A printing machine according to claim 25, further including a fabric secured to said tubular member and having said tufts woven therethrough.

27. A printing machine according to claim 26, wherein said fabric includes a conductive coating.

28. A printing machine according to claim 27, wherein said tufts are woven through said fabric in a W-shaped configuration.

29. A printing machine according to claim 27, wherein said tufts are woven through said fabric in a U-shaped configuration.

30. A printing machine according to claim 28 or 29, wherein said fibers are made preferably from stainless steel.

* * * * *